United States Patent [19]

Simeth

[11] Patent Number: 4,697,512

[45] Date of Patent: Oct. 6, 1987

[54] SHEET GRIPPER SYSTEM FOR A PRINTING PRESS

[75] Inventor: Claus Simeth, Offenbach am Main, Fed. Rep. of Germany

[73] Assignee: M.A.N.-Roland Druckmaschinen Aktiengesellschaft, Offenbach am Main, Fed. Rep. of Germany

[21] Appl. No.: 808,827

[22] Filed: Dec. 13, 1985

[30] Foreign Application Priority Data

Dec. 15, 1984 [DE] Fed. Rep. of Germany ..... 3445886

[51] Int. Cl.[4] ..... B41F 9/00

[52] U.S. Cl. ..... 101/142; 101/410; 271/82; 271/268; 271/277

[58] Field of Search ..... 101/142, 144, 137, 177, 101/217–218, 246–247, 409, 410, 415.1; 271/268, 277, 82

[56] References Cited

U.S. PATENT DOCUMENTS

| | | | |
|---|---|---|---|
| 2,859,692 | 11/1958 | Mestre | 101/217 |
| 2,926,909 | 3/1960 | Jantzen | 271/268 |
| 3,430,946 | 3/1969 | Siebke | 271/277 |
| 3,606,308 | 9/1971 | Mowry et al. | 271/277 |
| 3,637,202 | 1/1972 | Mowry et al. | 271/277 |
| 3,865,362 | 2/1975 | Luffy et al. | 101/410 |
| 3,926,118 | 12/1975 | Preuss | 101/246 |
| 4,343,241 | 8/1982 | Rudolph et al. | 271/82 X |
| 4,372,209 | 2/1983 | Jentzsch et al. | 101/409 |
| 4,475,459 | 10/1984 | Wanke et al. | 101/410 |
| 4,535,691 | 8/1985 | Kida | 271/82 |

FOREIGN PATENT DOCUMENTS

| | | | |
|---|---|---|---|
| 3220364 | 12/1983 | Fed. Rep. of Germany | 101/409 |
| 507522 | 6/1939 | United Kingdom | 101/409 |
| 934464 | 8/1963 | United Kingdom | 101/409 |

*Primary Examiner*—E. H. Eickholt

*Attorney, Agent, or Firm*—Leydig, Voit & Mayer

[57] ABSTRACT

An improved sheet gripper system disposed on the impression cylinder of a printing press having regular sheet grippers mounted on a gripper shaft on the impression cylinder with additional grippers provided in the spaces between the regular grippers, which spaces are intended for cooperating transfer grippers, the additional grippers being adapted to retract into a gripper channel and extend out into the gripper plane only in one zone of the movement of the impression cylinder in which the between-gripper spaces are freed of the cooperating transfer grippers so that the front edge of a sheet is held by both the regular grippers, as it passes through the printing zone, and the additional grippers and the tension to which the printing material is subjected is greatly reduced, and the registry and print quality are improved.

20 Claims, 10 Drawing Figures

SHEET GRIPPER SYSTEM FOR A PRINTING PRESS

FIELD OF THE INVENTION

The present invention relates generally to a gripper system for conveying sheets by their front edges through the printing zone of a printing press, and more particularly concerns a plurality of additional grippers mounted on an impression cylinder in the spaces between the regular grippers, in which spaces the cooperating transfer grippers engage the sheet edge during sheet supply to and delivery from the impression cylinder.

BACKGROUND OF THE INVENTION

Sheet gripper systems of the kind indicated are generally known in printing machines. They pull the sheet past the ink transfer cylinder during printing, and in so doing take the tension forces acting on the sheet. Since it is not possible to vary the number and spacing of the individual grippers, because of other design considerations, the tensile forces at the gripper clamping point may reach the limits of tensile sheet loading, particularly in the case of thinner materials for printing. This, of course, has an adverse effect on the quality of the print and the possible printing speed. For example, in offset printing, ink may be re-transferred from the paper surface to the blanket cylinder of a subsequent printing unit; this results in mackling if the re-transferred ink is not transferred in correct register as a result of dimensional variations due to the clamping conditions.

SUMMARY AND OBJECTS OF THE INVENTION

The primary aim of the present invention is to provide a sheet gripper system for the impression cylinder of printing presses that reduces the tensile stresses in the sheet material being printed and thus obviates the disadvantages of mackling and blurring.

To this end, according to the invention, additional grippers are disposed in the spaces between the regular grippers; in a zone of movement of the impression cylinder in which the between-grippers spaces are free of the cooperating transfer grippers, the additional grippers are movable into the gripper plane in the between-gripper spaces, where they hold the front edge of the sheet as it passes through the printing zone. The advantage of the improved gripper system according to the invention is that the front edge of the sheet is held by approximately twice the number of grippers before it enters the printing zone, so the tensile stress on the material as it passes through the printing zone is reduced to approximately half or even more. This leads to a considerable reduction of the elongation of the material and of the possible differences in elongation, so the print quality is greatly improved. Any set-off ink is subsequently transferred in accurate register and no longer results in mackling. The additional grippers disposed at the free corners of the sheet prevent the side edges of the sheet from distorting inward and also avoid narrower printing along the side edges of the sheet.

Reduction of the tensile stress on the material being printed also enables use to be made of thinner or less stable papers and higher printing pressure settings. Non-register of the machine between starting-up and the operating state is largely obviated by the gripper system construction according to the invention, so in many cases it is possible to dispense with the conventional temperature control means for keeping a smooth ink flow and cycle time constant.

According to another object of the invention, optimum clamping conditions are obtained if the additional grippers extend over substantially the entire width of the between-gripper spaces. This gives essentially a 100% space utilization for the grippers at the front edge of the sheet, so that the stresses in the material undergoing printing are at the minimum possible value. The regular grippers and additional grippers in these conditions form a closed gripper strip to some extent, so that there are no longer any between-gripper spaces present to cause differences in elongation in the material being printed. Gripping the entire front edge of the sheet means that the gripper system retaining forces can be kept relatively low, and damage to the sheet front edge is substantially eliminated. The gripper system according to the invention is therefore suitable for substantially all printing materials.

Pursuant to the invention, the additional grippers may hold the sheet with mechanical, pneumatic or electrostatic means. These means may act on the conventional sheet gripper edge without damaging or destroying the material for printing.

In a preferred embodiment of the invention, a control shaft is mounted in the impression cylinder for the purpose of moving the additional grippers into and out of the gripper plane. The control shaft is operatively connected to the additional grippers via levers or cams; the actuating movement thereof is produced by a control cam on the printing machine column. Advantageously, the actuating movement is transmitted from the control cam to the control shaft by a cam follower, which in one direction of rotation bears against the control shaft by way of a spring. As a result of this construction, the control cam can have an over-travel, i.e.; stops or the like can be used, for example, to limit the actuating movement of the control shaft to a value less than the cam follower operative path produced by the cam. The advantage of this is that the position of the additional grippers in the gripper plane is accurately adjustable by stops or the like without interfering with the control system.

In further keeping with the preferred embodiment, the additional grippers have movable gripper supports pivotally connected to the control levers of the control shaft, and guided by a roller on a control surface in the impression cylinder. The interaction of the control surface and control lever cause the gripper supports to be moved radially and tangentially relative to the impression cylinder such that no damage can occur to the sheet front edge.

To hold the sheet with mechanical means, according to the invention, gripper fingers can be mounted on a common actuating shaft on the gripper supports; and the gripper fingers are pressed into a closed position by springs and are opened against the spring force by rotation of the actuation shaft. Advantageously, in this case, the actuating shaft can be rotated by a cam follower movable by means of a cam disc fixed on the control shaft. Opening and closing of the additional grippers and their movement into and out of the gripper plane can be exactly coordinated by simple means in this way.

Another advantageous aspect of the invention is that the additional grippers are interconnected by a strut adapted to retract into the impression cylinder channel substantially radially on a column guide. Advantageously suction grippers may be secured to the strut since they do not extend beyond the edge of the sheet. According to the invention, the suction grippers preferably have a suction chamber adapted to be connected to a suction source via a valve strip; the valve strip control is effected by the movement of the suction grippers into and out of the gripper plane. Pursuant to a still further aspect of the invention, to facilitate the sheet delivery to the transfer gripper system, the suction grippers can be controlled to blow air outwardly. As a result, the suction ports are cleaned at the same time.

In a preferred embodiment of the invention, the suction grippers consist of a gripper sleeve that carries a suction cup with a perforate suction cover; the sleeves are guided in bearing bores in the legs of a U-shaped member disposed in the gripper. channel. This embodiment is easy to produce and can be accommodated in the space available in the gripper channel without any appreciable structural modifications. Advantageously, in this embodiment, the connection between the suction grippers and the suction source is controllable by a valve system, which is closed before the suction grippers are retracted and opened after they are extended. The additional suction required to hold the sheet front edge is therefore operative only while the suction grippers are in the gripper plane. This obviates any damage to the sheet front edge during retraction of the suction grippers.

A simple valve means to obtain an operation of this kind is provided by another aspect of the invention in which the valve means consists of a valve sleeve that is displaceable on the gripper sleeve. By way of abutments the valve sleeve transmits the retraction movement of a drive means to the gripper sleeve, movable into the gripper plane by means of springs. Before the abutments touch one another, the valve sleeve is displaceable independently of the gripper sleeve to an extent such that it closes the suction source connecting bore leading to the gripper sleeve. Advantageously, the movement of the gripper sleeve into the gripper plane is produced by compression springs supported on the valve sleeve. In this way, the gripper sleeve and the valve sleeve are resiliently biased relative to one another; the inreasing spring force on extension of the gripper sleeves allows a high speed of extension.

These and other objects and advantages of the invention will become more readily apparent from reading the following detailed description and upon reference to the drawings, in which:

Figure 1:
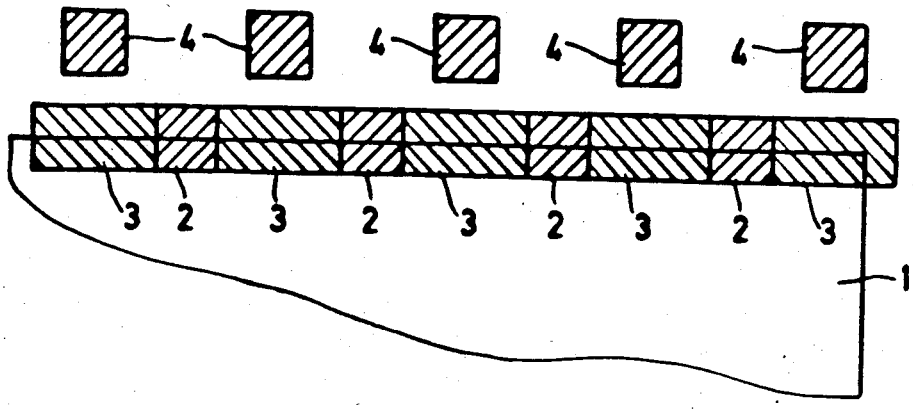
FIG. 1 is a diagrammatic view of the improved gripper system of the present invention at the front edge of a sheet to be printed.

While the invention is susceptible to various modifications and alternative constructions, certain preferred embodiments have been shown in the drawings and will be described further below in detail. It should be understood, however, that there is no intention to limit the invention to the specific embodiments illustrated and described, but, on the contrary, the intention is to cover all modifications, alternative constructions and equivalents as fall within the spirit and scope of the invention.

DESCRIPTION OF THE PREFERRED EMBODIMENTS

Turning now to the drawings, FIG. 1 shows a schematic plan view of the sheet gripper arrangement of the present invention. The front edge of a sheet 1 is shown being held by a plurality of spaced-apart regular sheet grippers 2 and additional sheet grippers 3 disposed on the impression cylinder of a printing press. As shown here, the respective grippers 2, 3 are denoted by opposite cross-hatching. It will be seen that the additional grippers 3 substantially fill those spaces between the regular grippers 2, into which spaces cooperating transfer grippers 4 are movable for delivering and removing successive sheets 1.

Preferably the regular grippers 2 and the additional grippers 3 combine to form a substantially continuous gripper strip. In this way the front edge of the sheet 1 is held substantially entirely along its leading edge; as a result, the localized tension and stresses in the sheet due to inking and pressure adjustment forces during sheet printing are reduced to a minimum. Since the localized stress and expansion forces are substantially reduced, more accurate printing registry is achieved and a considerable improvement in print quality is obtained, particularly in multi-color offset printing, by using the improved sheet gripper system of the present invention.

Figure 2:
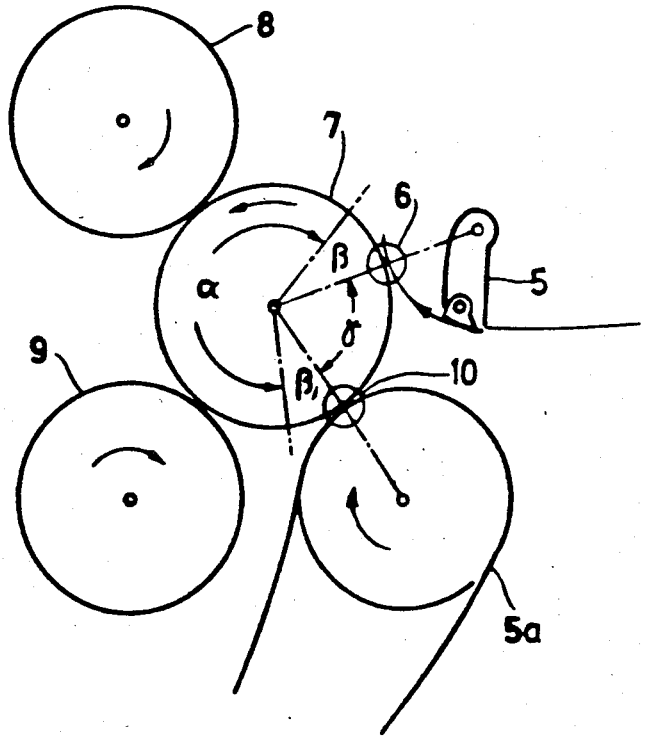
FIG. 2 is a schematic diagram of a printing machine showing the zones of sheet travel in relation to the gripper control system.

In FIG. 2, a schematic side elevation of a double printing unit of a multi-color offset printing press is shown to illustrate the timed control of the improved gripper arrangement of the present invention. As illustrated here, the sheets (not shown) to be printed are fed by a rocking transfer gripper 5 which delivers the sheets to the regular gripper on the impression cylinder 7 at the transfer point 6.

For printing the sheets, circumferentially offset blanket cylinders 8, 9 bear against the impression cylinder 7 and cooperate conventionally with plate cylinders (not shown). After passing the blanket cylinders 8, 9, the sheets are taken over by the grippers of a chain gripper system 5*a* at the take-over point 10 and transported to a subsequent printing unit. During transfer of a sheet at the transfer point 6, the gripper fingers of the rocking gripper 5 engage the forward edge of the sheet in the spaces between the regular grippers 2. The additional grippers 3 are therefore controlled to be out of the way, so they are withdrawn outside the range of movement of the gripper fingers 5. While the impression cylinder 7 rotates counterclockwise through the supply zone defined by the angle $\beta$, taking a sheet 1 with it, the additional grippers 3 are controlled to be operative, so as the sheet 1 comes into the printing zone defined by the angle $\alpha$ the additional grippers 3 grip the sheet front edge firmly. The additional grippers 3 are left in operation during travel through the angle $\alpha$, and, together with the grippers 2, they transport the sheet 1 past the blanket cylinders 8, 9.

After passing through the angle $\alpha$ and before reaching the take-over point 10, the additional grippers 3 are controlled to be inoperative in the discharge zone defined by the angle $\beta_1$, so that the between-gripper spaces are free for enagement of the fingers of the chain gripper system 5a upon deliver of the sheet thereto. The additional grippers remain out of operation in the inactive zone defined by the angle $\gamma$ so that the between-gripper spaces are free for the next sheet to be supplied by the rocking gripper 5.

Figure 3:
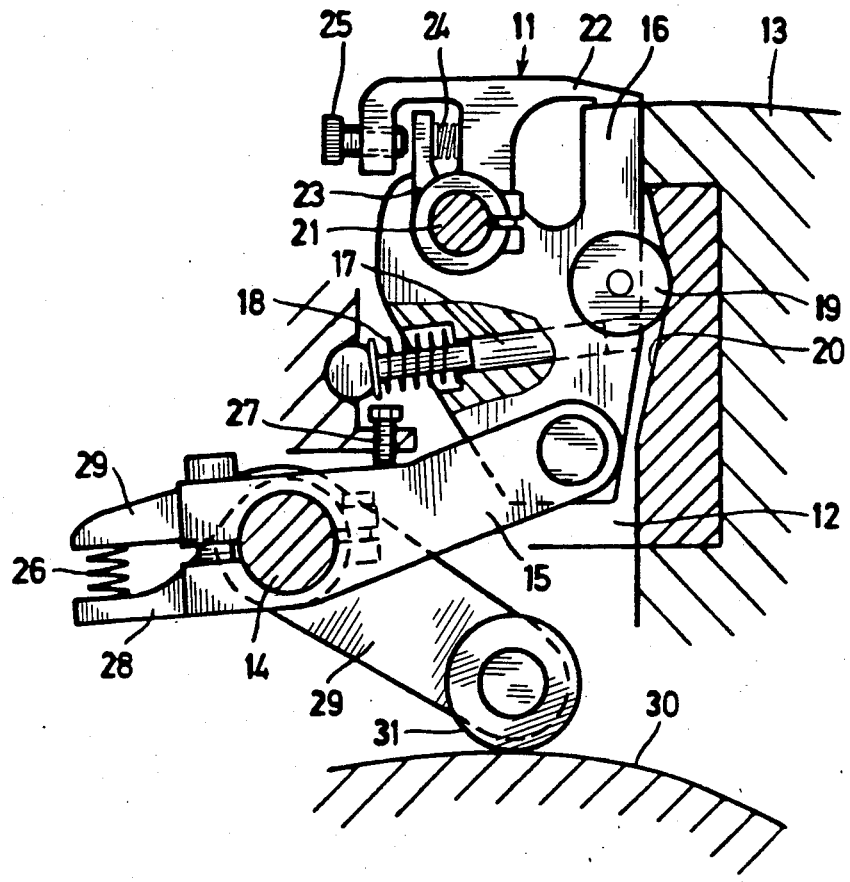
FIGS. 3 and 4 are enlarged, fragmentary sectional views in the direction of the impression cylinder axis showing a mechanical additional gripper and control means.

In the exemplified embodiment of a mechanical additional gripper 11 shown in FIG. 3, a control shaft 14 is mounted rotatably in the gripper channel 12 of an impression cylinder 13 parallel to the cylinder axis. Control levers 15 are clamped on the control shaft 14, and a gripper support 16 is pivotally connected to the end of each such control lever. The gripper supports 16 are pressed against the side wall of the gripper channel 12 by a compression spring 18 disposed on a guide pin 17; a roller 19 on the gripper supports 16 bears against a control surface 20 formed in the side wall.

The gripper supports 16 are interconnected by an actuating shaft 21 mounted in bores in the supports 16. Associated with each support 16 is a gripper finger 22, which is mounted on the actuating shaft 21 and is movable into an open position and a closed position by rotation of the shaft 21, via a clamp member 23 secured on the shaft. A compression spring 24 is clamped between the gripper finger 22 and the member 23 in order to determine the closing force. An adjusting screw 25 is provided for adjustment of the opening movement of the gripper finger 22.

FIG. 3 shows the additional gripper 11 in the closed position in the gripper plane, in which it holds the front edge of a sheet 1. In this position, the control lever 15 is pressed by a spring 26 against an adjustable abutment 27 by means of which the gripper support 16 can be accurately adjusted into the gripper plane. The spring 26 is clamped between a clamp member 28 fixed to the control shaft 14 and a cam follower 29, which is mounted on the control shaft; on rotation of the impression cylinder 12, the cam follower is moved by a cam 30 secured to the machine column, and on which it is guided via a roller 31. The cam 30 is so designed as to move the additional gripper 11 into or out of the gripper plane in a manner corresponding to the zones or angular control sections $\alpha$, $\beta$,$\beta_1$ and $\gamma$ shown in FIG. 2.

Figure 4:
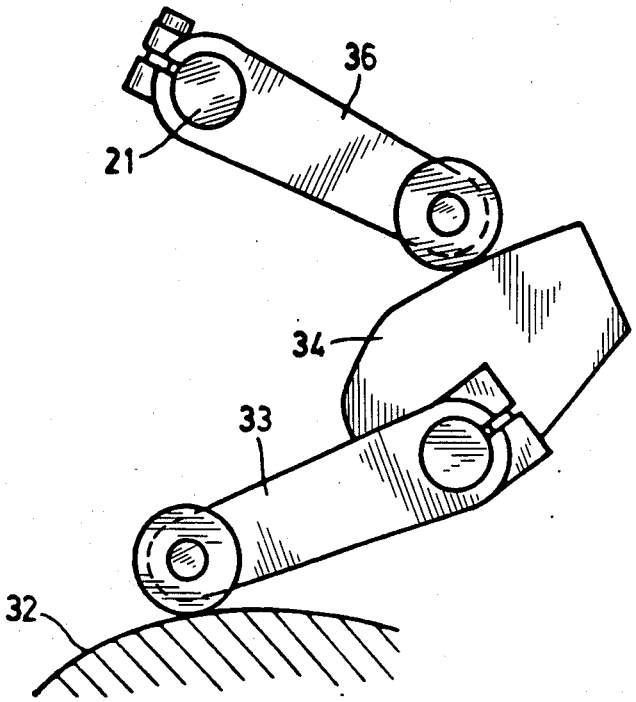
Figure 5:
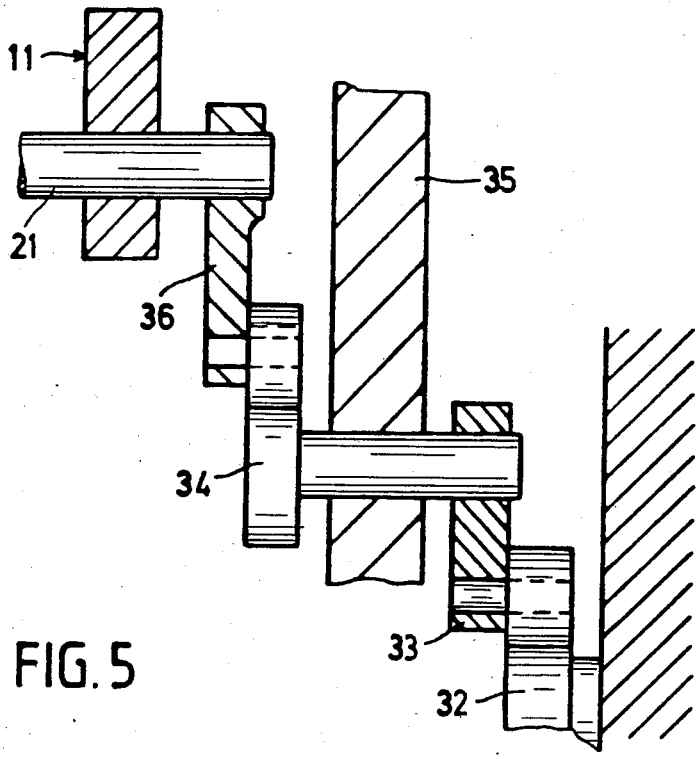
FIG. 5 is a front elevation, partially in section, of the control system for the additional grippers shown in FIGS. 3 and 4.

Opening and closing of the additional grippers 11 in the machine cycle is controlled by the control system shown in FIGS. 4 and 5. A cam 32 secured to the machine column pivots a cam disc 34 via a cam follower 33 on rotation of the impression cylinder 13, on whose bearing 35 the cam disc 34 is mounted. By its movement, the cam disc 34 pivots a cam follower 36 connected to the actuating shaft 21 of the additional grippers 11 so as to rotate therewith. A control movement originating from the control cam 32 thus results in rotation of the actuating shaft 21 in either direction, so that the additional grippers are opened or closed. In these conditions the interposed cam disc 34 provides the advantage of controlling the opening and closing movement of the additional grippers by the use of the same cam on the machine column as is used to control the retraction and extension of the additional grippers.

Figure 6:
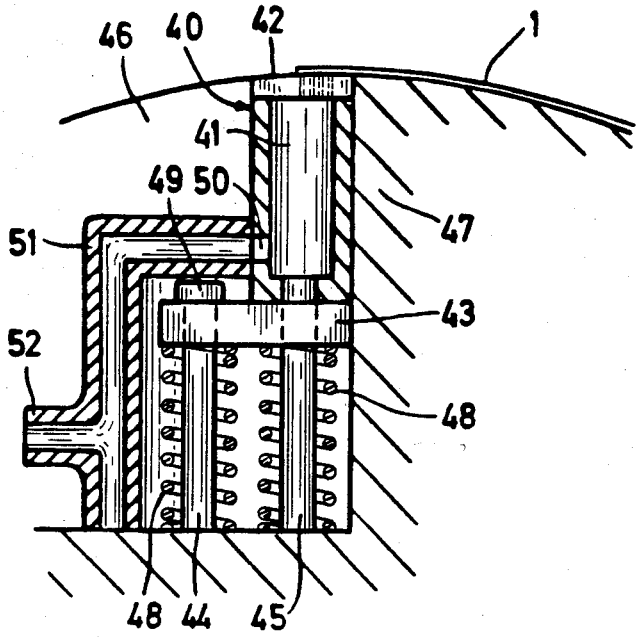
FIG. 6 is an enlarged fragmentary sectional view showing a pneumatic suction gripper in the extended position.
Figure 7:
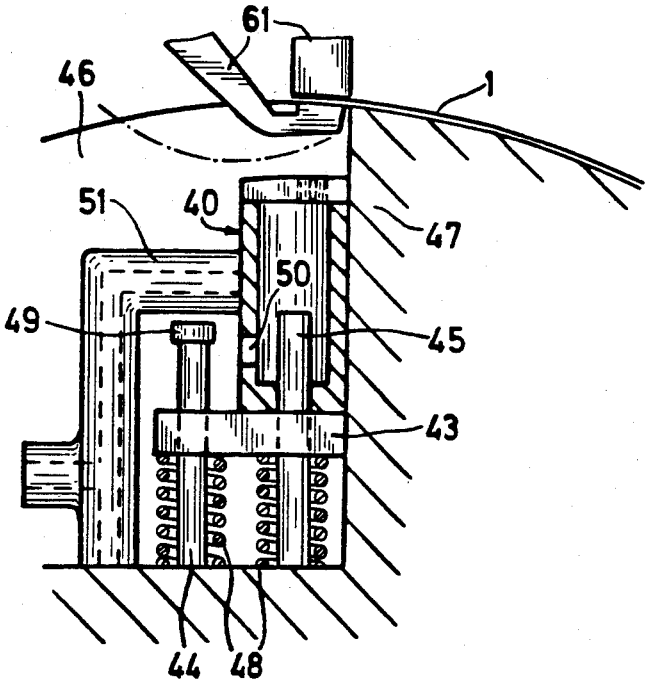
FIG. 7 is a view, similar to FIG. 6 showing the suction gripper according to FIG. 6 in the countersunk position.
Figure 8:
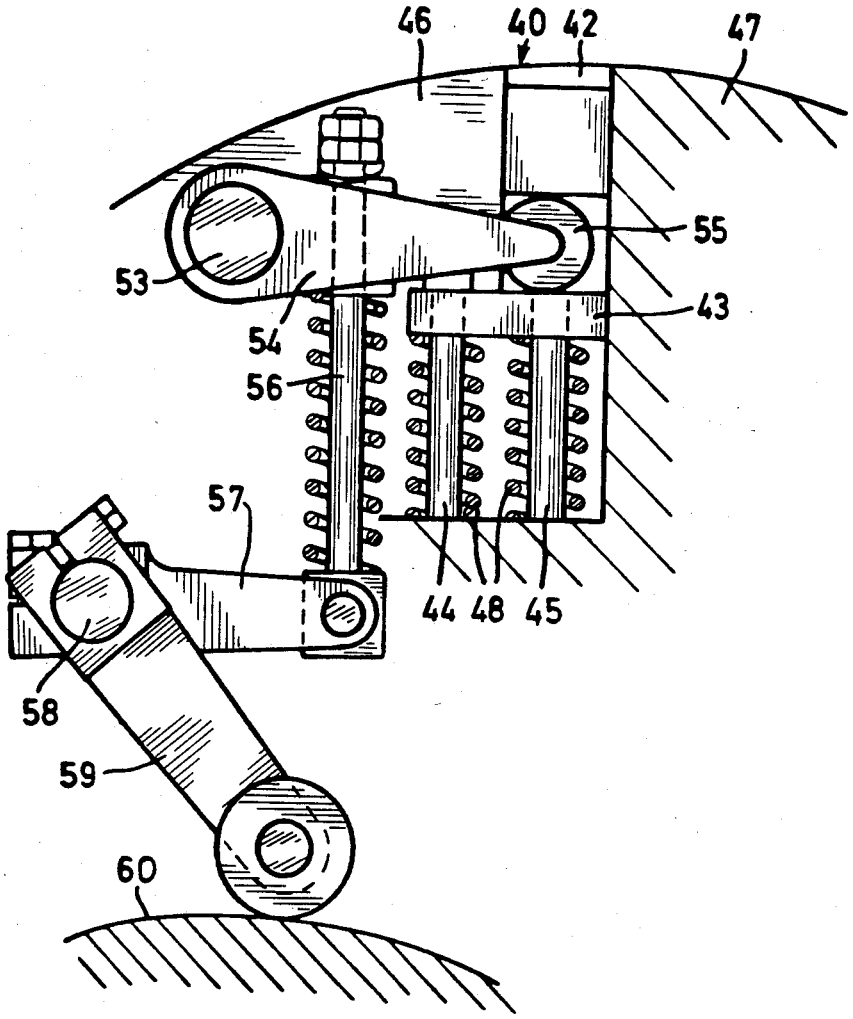
FIG. 8 is a partial sectional view of a control system for a suction gripper of the kind shown in FIG. 6.

In the exemplified embodiment shown in FIGS. 6 to 8, the additional grippers are constructed as suction grippers 40. They consist of suction chambers 41, the width of which corresponds to the between-gripper space; they have a perforate or porous suction cover 42 at their end facing the gripper plane. The suction chambers 41 are secured to a continuous strut 43, which is guided to be radially displaceable on posts 44, 45 in a gripper channel 46 of an impression cylinder 47. Compression springs 48, which bear against the base of the gripper channel 46, press the strut 43 radially outwards against the adjustable stops 49 at the head of the posts 44. The suction chambers 41 have a lateral port 50 by means of which they can be connected to a suction connection 52 via a valve strip 51 when in the extended position, and to atmosphere when in the retracted position.

To extend and retract the suction grippers 40, control levers 54 are mounted rotatably on the gripper shaft 53 of the impression cylinder 47 and act radially from outside on the strut 43 by means of a roller 55 at their ends. The control levers 54 are pivotally connected to adjustment levers 57 of a control shaft 58 via pull rods 56. The control shaft 58 is also mounted in the impression cylinder 47 and is rotatable via a cam follower 59 engaging a control cam 60 in the side column of the printing machine.

FIG. 6 shows the suction grippers 40 in the extended position during the holding of the front edge of a sheet 1 in connection with the regular impression cylinder grippers (not shown). The suction chambers 41 are connected to the suction connection 52 via the valve strip 51, thus producing a vacuum which is operative on the underside of the sheet 1 via the suction cover 42 and produces the required holding force in conjunction with the external air pressure acting on the sheet 1. The suction grippers 40 remain in this position while the front edge of the sheet passes through the angle zone $\alpha$ as shown in FIG. 2 for the printing unit.

As the front edge of the sheet enters the angle $\beta$, zone shown in FIG. 2, the suction grippers 40 are moved radially inwards by means of the strut 43 by the lever control system shown in FIG. 8, so that the suction covers 42 separate from the sheet 1. The ports pass out of engagement with the valve strip 51 and thus provide a rapid pressure equalization in the suction chambers 41. At the same time, the ports in the valve strip 51 are closed by the side wall of the suction chambers. The suction grippers are moved into the gripper channel 46 so that the between-gripper space is freed for the approach of the cooperating grippers 61. FIG. 7 shows this retracted position of the suction grippers 40.

Figure 9:
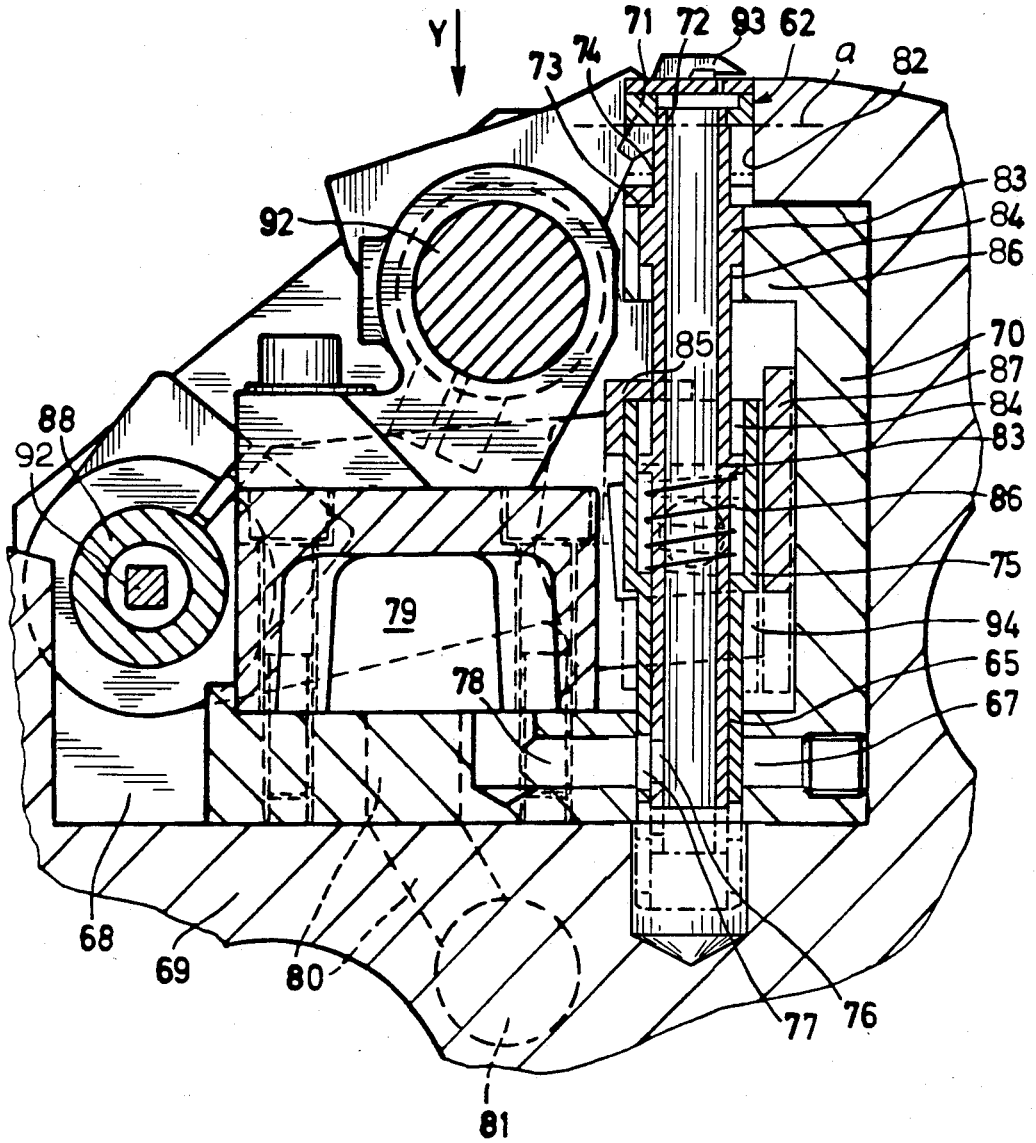
FIG. 9 is an enlarged, fragmentary cross-section through the gripper channel of an impression cylinder having a different suction gripper arrangement; and, FIG. 10 is a partial view, as seen in the direction Y of FIG. 9, of the suction gripper arrangement shown in FIG. 9.
Figure 10:
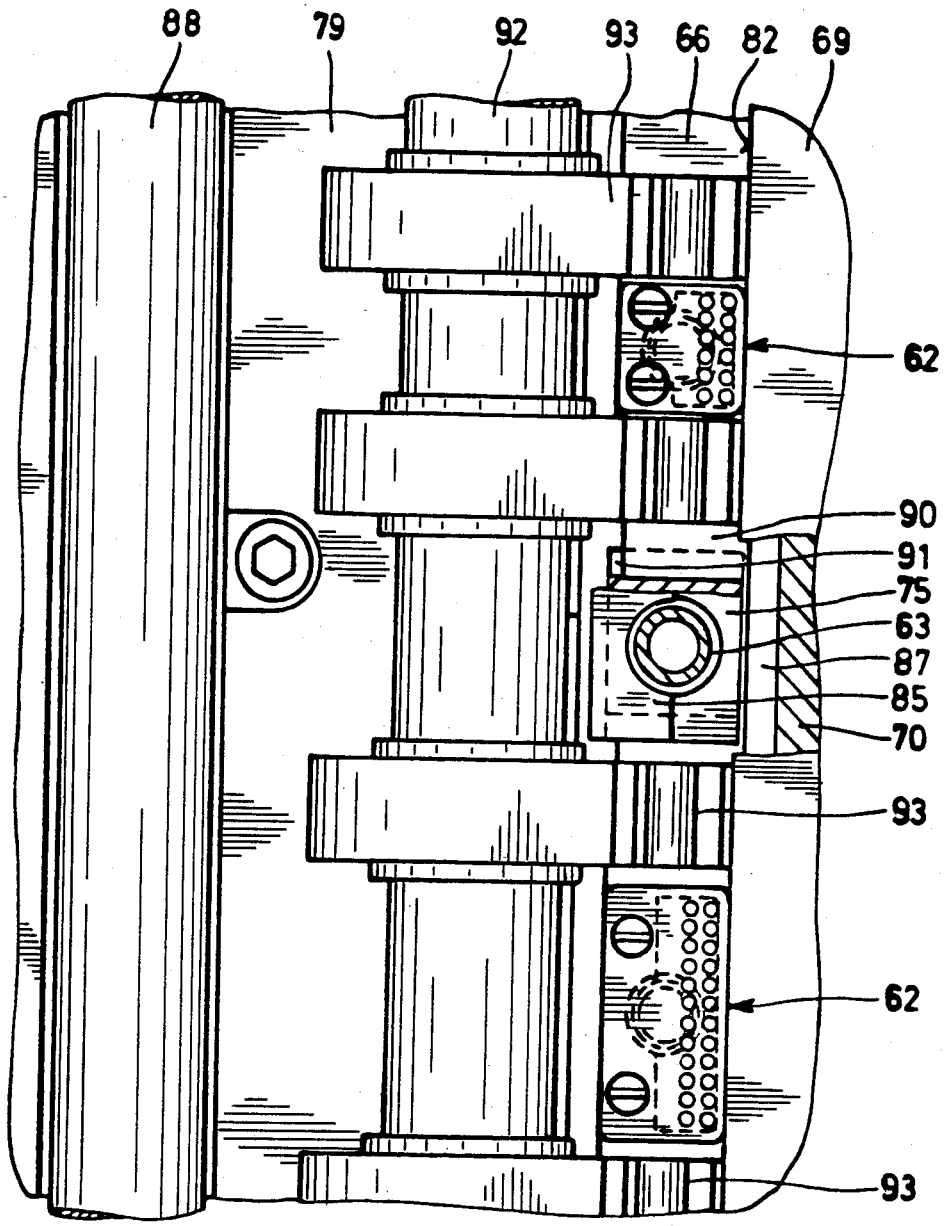

FIGS. 9 and 10 show another embodiment of additional grippers in the form of suction grippers, in which the suction grippers 62 consist of cylindrical gripper sleeves 63 mounted to be radially slidable in bearing bores 64 in the opposite legs 66, 67 of a U-shaped member 70 fixed in the gripper channel 68 of an impression cylinder 69. At their radially outer ends the gripper sleeves 63 carry block-shaped suction cups 71 having a perforate suction cover 72, the surface of which lies in the gripper plane when the suction grippers 62 are extended. This position of the suction grippers 62 is defined by abutment plates 73, which limit the outward movement of the suction grippers 62. The plates 73 are screwed to the leg 66 and engage in a recess 74 provided beneath the suction cups 71 in the outer surface of the gripper sleeves 63.

Valve sleeves 75 fit over the radially inner end of the gripper sleeves 63, and engage by their radially inner ends directly in the bearing bores 65, and thus also contribute to mounting the gripper sleeves 63. Radial bores 76, 77 are provided in the gripper sleeves 63 and in the valve sleeves 75 and are situated inside the bearing bore 65 in the extended position of the suction grippers 62 shown in FIG. 9, where they register with a connecting bore 78 leading radially into the bearing bore 65. Bore 78 communicates via a transverse bore with a suction chamber 79 connected via bores 80 to a suction connection 81 in an end face of the impression cylinder 69. The gripper sleeves 63 are prevented from any rotary movement about their longitudinal axis by the suction cups 71 being guided on a flat surface 82 of the impression cylinder 69, in order to ensure alignment of the radial bore 76 in relation to the connecting bore 78. In the case of the valve sleeves 75, a corresponding means of preventing rotation is provided by a rectangular section outer contour for the radially outer widened part of the valve sleeves.

The gripper sleeves 63 and the valve sleeves 75 are displaceable in the longitudinal direction with respect to one another to a limited degree. To limit the displacement movement, each gripper sleeve 63 has an abutment collar 83 situated in the widened part 84 of the bore of the associated valve sleeve 75 and is adapted to bear against an abutment bracket 85 on the valve sleeve 75, said bracket partially covering the open end of the bore portion 84. A compression spring 86 provided between the base of the bore portion 85 and the abutment collar 82 tends to press the collar 83 against the bracket 85.

For the retraction and extension of the suction grippers 62, a strut 87 of T section is provided that extends between the legs 66, 67 over the entire length of the gripper channel 68. At its ends, the strut 87 is pivotally connected to control levers 94 secured to a control shaft 88. In the manner already described in connection with the previous exemplified embodiment, control shaft 88 is rotated to and fro by means of a cam follower and a cam on the machine column, depending upon the rotary movement of the impression cylinder. A torsion bar spring 89 disposed on the control shaft 88 is used as a return spring. The middle web 90 of the strut 87 extending parallel to the legs 66, 67 has a recess for each suction gripper 62, the latter being inserted therein by their valve sleeves 75. The side surfaces of the valve sleeves 75 are formed with transverse grooves 91 in which the middle web 90 engages. The valve sleeves 75 are thus positively connected to the strut 85 to transmit the driving movement and are additionally secured against turning.

FIG. 10 shows the arrangement of the additional suction grippers 62 in the spaces between the regular grippers 93 disposed on a gripper shaft 92.

The operation of the additional grippers shown in FIGS. 9 and 10 is as follows:

The additional suction grippers 62 are shown in the extended suction position in FIG. 9, in which the regular grippers 93 are closed. In this position the gripper sleeves 63 are pressed against the abutment plates 73 by the compression springs 86. The valve sleeves 73 rest on the middle web 90 of the strut 87 in its extended position. The radial bores 76, 77 are in line with the connecting bore 78 so that the suction cups 71 communicate with the suction chamber 79 via the inner bore of the gripper sleeves 63. A vacuum thus forms at the perforate suction covers 72 and retains the edge of a sheet bearing on the suction covers.

Before the sheet is taken over or transferred, the suction grippers 62 must be retracted to create the space required for the approach of the cooperating grippers. To this end, the valve sleeves 75 are moved radially inwards by the strut 87, during which they close the connecting bores 78. As a result the pressure inside the gripper sleeves 63 and the suction cups 71 becomes equal to atmospheric pressure, so the suction covers 72 can readily be separated from the front edge of the sheet without damaging the same. After closure of the connecting bores 78, the brackets 85 bear against the abutment collars 83 so that the gripper sleeves 63 are also moved radially inwards until their suction covers 72 have been retracted into the gripper channel 68 to such an extent that the cooperating grippers can reach the front edge of the sheet without obstruction. In the retracted end position the surface of the suction covers 72 is level with the dot-dash line a.

Extension of the suction grippers 62 after the takeover of a sheet takes place in the correspondingly reversed sequence. The gripper sleeves 63 and the valve sleeves 75 are first jointly moved outwards until the gripper sleeves 63 bear against the abutment plates 73. The drive power is transmitted by the valve sleeves 75 to the gripper sleeves 63 via the compression springs 86. The valve sleeves 75 are then moved into the position shown in FIG. 9, the compression springs 86 being compressed and the connecting bores 78 opened. The vacuum in the suction chamber 79 is transmitted to the suction cups 71 and causes the front edge of the sheet to be held in the region between the grippers 93.

I claim as my invention:

1. A gripper system for conveying successive sheets by the front edges through the printing zone of a printing press having an impression cylinder supported for rotation on a machine column, comprising means for rotating the impression cylinder through a machine cycle including a printing zone ($\alpha$), a sheet supply zone ($\beta$), a sheet discharge zone ($\beta_1$) and inactive zone ($\gamma$), a plurality of regular sheet grippers mounted on the impression cylinder with spaces between the grippers, in which spaces cooperating transfer grippers engage the sheet edge during sheet supply and delivery to the impression cylinder, characterized in that additional sheet grippers are disposed between the regular grippers, means for moving said additional sheet grippers into the gripper plane in the between-gripper spaces, where they hold the front edge of the sheet as is passes through the printing zone ($\alpha$) and means for moving the additional sheet grippers out of the gripper plane as the additional grippers pass through the sheet discharge zone ($\beta_1$) and the inactive zone ($\gamma$).

2. A gripper system according to claim 1, characterized in that the additional grippers extend over substantially the entire width of the between-gripper spaces.

3. A gripper system according to claim 1, characterized in that the additional grippers hold the sheet by mechanical means.

4. A gripper system according to claim 1, characterized in that the additional grippers hold the sheet by pneumatic means.

5. A gripper system according to claim 1, characterized in that a control shaft is mounted in a channel in the impression cylinder for the purpose of moving the additional grippers into and out of the gripper plane and the control shaft is operatively connected to the additional grippers via levers or cams and the actuating movement thereof is produced by a control cam on the machine column.

6. A gripper system according to claim 5, characterized in that the actuating movement for the additional grippers is transmitted from the control cam to the control shaft by a cam follower which in one direction of rotation bears against the control shaft by way of a spring.

7. A gripper system according to claim 6 characterized in that the additional grippers have movable gripper supports which are pivotally connected to the control levers of the control shaft and which are guided by a roller on a control surface in the impression cylinder.

8. A gripper system according to claim 7, characterized in that gripper fingers are mounted on a common actuating shaft on the gripper supports and are pressed into a closed position by springs and are openable against the spring force by rotation of the actuation shaft.

9. A gripper system according to claim 8, characterized in that the actuating shaft is rotatable by means of a cam disc fixed on a control shaft, and by way of a cam follower.

10. A gripper system according to claim 5, characterized in that the position of the additional grippers in the gripper plane is locatable by an adjustable abutment in the channel of the impression cylinder.

11. A gripper system according to claim 1, characterized in that the additional grippers are mounted on a rectilinear guide and are retractable substantially radially into a channel formed in the impression cylinder.

12. A gripper system according to claim 11, characterized in that the additional grippers are interconnected by a strut movable in the direction of the rectilinear guide by drive means in time with the machine cycle.

13. A gripper system according to claim 4, characterized in that the additional grippers are constructed in the form of suction grippers adapted to be connected to a suction source via a valve strip.

14. A gripper system according to claim 13, characterized in that the connection between the suction grippers and the suction source is controllable by a valve means which is closed before retraction of the suction grippers and opened after the extension thereof.

15. A gripper system according to claim 14, characterized in that the valve means are controlled by the movement of the suction grippers into and out of the gripper plane.

16. A gripper system according to claim 15, characterized in that the suction grippers consist of a gripper sleeve which carries a suction cup with a perforate suction cover, said sleeves being guided in bearing bores in the legs of a U-shaped member disposed in the gripper channel.

17. A gripper system according to claim 16, characterized in that the valve means consists of a valve sleeve which is displaceable on the gripper sleeve and which by way of abutments transmits the retraction movement of a drive means to the gripper sleeve movable into the gripper plane by means of springs and which, before the abutments touch one another, is displaceable independently of the gripper sleeve to an extent such that it closes the suction source connecting bore leading to the gripper sleeve.

18. A gripper system according to claim 17, characterized in that the gripper sleeve is movable into the gripper plane by means of a compression spring bearing on the valve sleeve.

19. A gripper system according to claim 13, characterized in that the suction grippers can be controlled to blow air therefrom.

20. A gripper system according to claim 12, characterized in that the strut is movable by means of control levers which are mounted rotatably on the gripper shaft and are pivotable by mechanical transmission means through the agency of a control cam on the machine column.

* * * * *